US008202100B2

(12) United States Patent
Luo

(10) Patent No.: US 8,202,100 B2
(45) Date of Patent: Jun. 19, 2012

(54) ELECTRICAL CONNECTOR CONNECTING TWO BOARD SHAPED DEVICE

(75) Inventor: Yu Luo, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/036,005

(22) Filed: Feb. 27, 2011

(65) Prior Publication Data

US 2012/0003849 A1 Jan. 5, 2012

(51) Int. Cl.
*H01R 12/00* (2006.01)

(52) U.S. Cl. ..... 439/66; 439/74

(58) Field of Classification Search ..... 439/66, 439/74

See application file for complete search history.

(56) References Cited

U.S. PATENT DOCUMENTS 5,484,295 A * 1/1996 Mowry et al. ..... 439/66
5,919,050 A * 7/1999 Kehley et al. ..... 439/71
5,975,914 A * 11/1999 Uchida ..... 439/66
6,132,220 A * 10/2000 McHugh et al. ..... 439/66
6,193,523 B1 * 2/2001 Harper, Jr. ..... 439/66
6,733,304 B1 * 5/2004 Liao ..... 439/66
6,758,702 B2 * 7/2004 Johnescu ..... 439/862
6,948,942 B1 * 9/2005 Chih ..... 439/66
7,037,113 B2 * 5/2006 Soh ..... 439/66
7,338,294 B2 * 3/2008 Polnyi ..... 439/66
7,510,402 B2 * 3/2009 Ma et al. ..... 439/71
7,625,217 B1 * 12/2009 Liao ..... 439/66
7,857,633 B2 * 12/2010 Hashimoto et al. ..... 439/66
7,878,818 B2 * 2/2011 Cheng et al. ..... 439/66

* cited by examiner

*Primary Examiner* — Gary F. Paumen
(74) *Attorney, Agent, or Firm* — Wei Te Chung; Andrew C. Cheng; Ming Chieh Chang

(57) ABSTRACT

An electrical connector includes a lengthwise insulating housing defining a central axis along a lengthwise direction and two groups of terminals disposed in the base portion. The housing includes a base portion and two mounting portions at opposite ends of the base portion. Each conductive terminal includes a retaining portion retained in the base portion, and a first and a second contacting portion extending oppositely from the retaining portion. The two groups of terminals are located at two sides of the central axis and the first contacting portions expose to a first surface of the base portion and the second contacting portions expose to a second surface opposite to the first surface of the base portion.

6 Claims, 8 Drawing Sheets

ELECTRICAL CONNECTOR CONNECTING TWO BOARD SHAPED DEVICE

BACKGROUND OF THE INVENTION

1. Field of the Invention

The present invention relates to an electrical connector connecting with two board shape device, such as SSD memory chips.

2. Description of Related Arts

Electrical connectors are widely and basically used in electronic assembly, device and system, for example, SATA (Serial Advanced Technology Attachment) connectors are used to connection between Hard Disk Drivers (HDD) and mother boards. SATA connector is also used in HDD storage. A new storage device named Solid State Disk or Solid State Driver is developed. Compared with conventional HDD storage, the SSD has advantage at higher performance, reduced power consumption, and reduced space requirements. Connectors adapted for said SSD device is desired. Especially, connectors reduced space requirements are highly desired.

SUMMARY OF THE INVENTION

An electrical connector comprises a lengthwise insulating housing defining a central axis along a lengthwise direction thereof and comprising a base portion and two mounting portions at opposite ends of the base portion and two groups of conductive terminals disposed in the base portion. Each conductive terminal comprises a retaining portion retained in the base portion, and a first contacting portion and a second contacting portion extending oppositely from the retaining portion. Said two groups of conductive terminals are located at two sides of the central axis and the first contacting portions expose to a first surface of the base portion and the second contacting portions expose to a second surface opposite to the first surface of the base portion.

Other advantages and novel features of the invention will become more apparent from the following detailed description of the present embodiment when taken in conjunction with the accompanying drawings

DETAILED DESCRIPTION OF THE PREFERRED EMBODIMENT

Further detailed description of the preferred embodiments of this present invention is set forth below along with the attached drawings.

Figure 1:
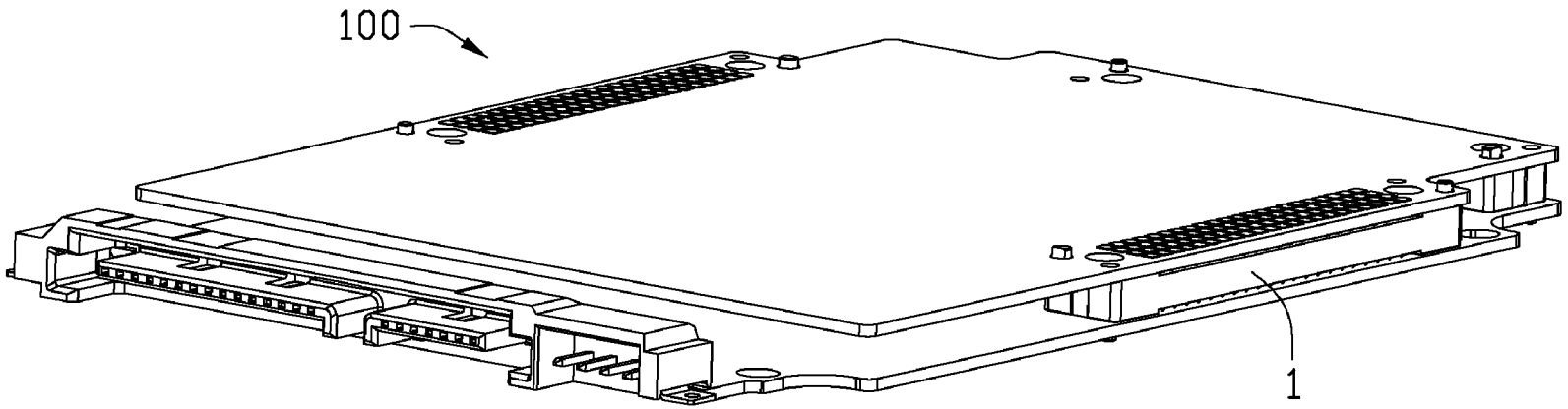
FIG. 1 is a perspective exploded view of an SSD device in accordance with the present invention.
Figure 2:
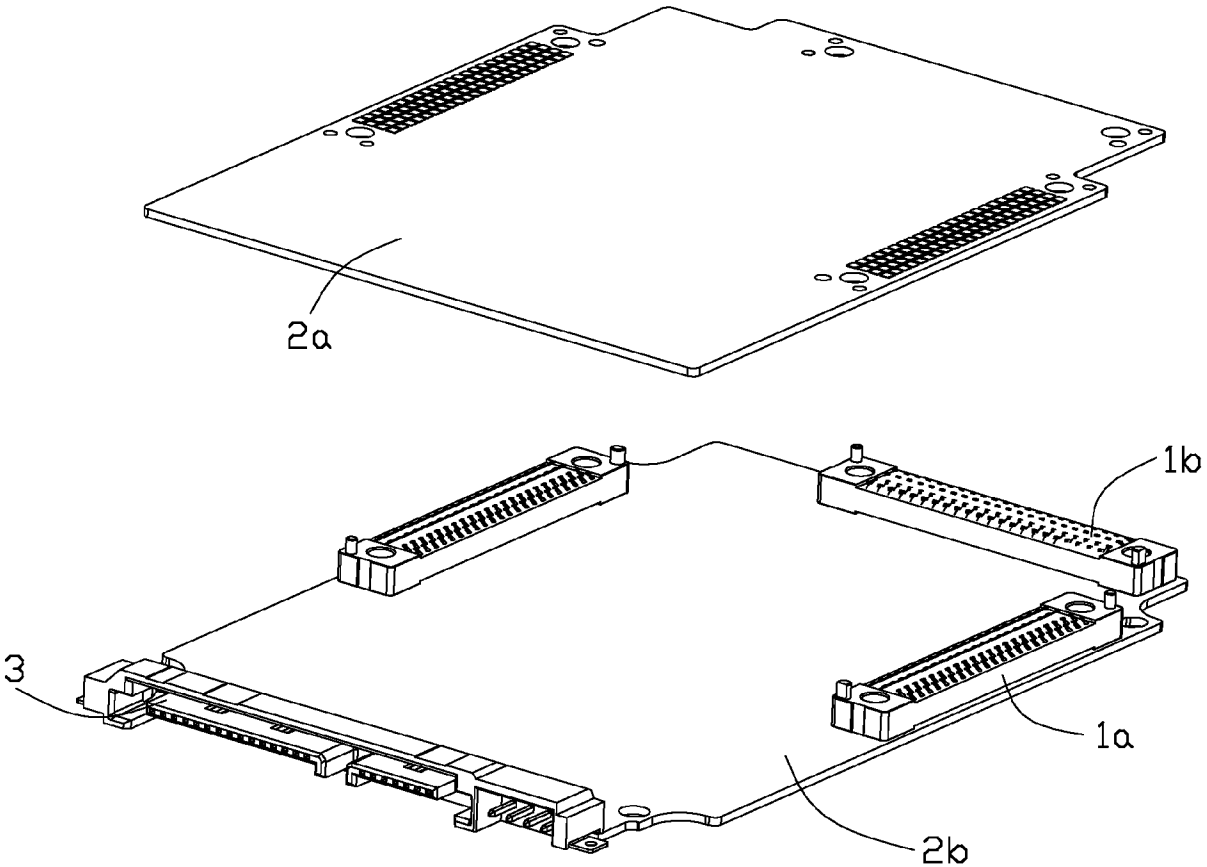
FIG. 2 is a top perspective exploded view of the SSD device.
Figure 3:
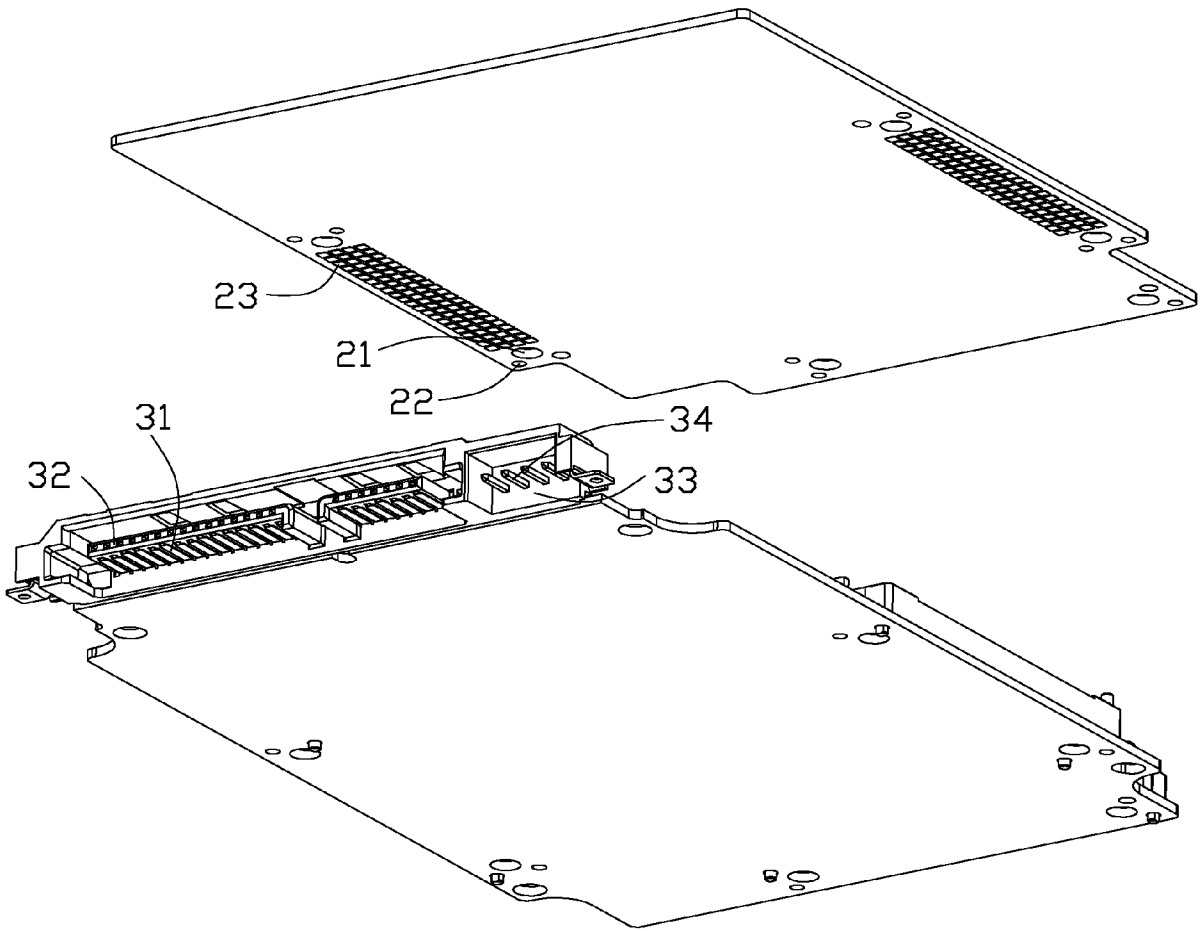
FIG. 3 is a bottom perspective exploded view of the SSD device.

Referring to FIGS. 1 through 3 showing an SSD device 100, the SSD device 100 substantially includes two SSD memory chips 2*a*, 2*b*, an I/O (Input/Output) connector 3 and three board to board (BTB) connector 1 connecting said two memory chips. The I/O connector is of a combo type and mounted on one edge of the second memory chip 2*b* and said one BTB connector 1*b* are mounted on an opposite edge of the second memory chip 2*b* to the I/O connector 3 and said another two BTB connector 1*a* are mounted on another two opposite edges of the first memory chip 2*b*. The I/O connector 3 comprises a first receiving cavity 31 surrounded by insulating body and two L-shaped tongues 32 are arranged in the receiving cavity side-by-side with conductive terminals (not labeled) on two opposite surfaces of the tongues, thereby a SATA compliable mating port is constructed. A second receiving cavity 33 is defined at side of the first receiving cavity 31 surrounded by insulating housing and a plurality of conductive pins 33 expose in the second receiving cavity 33 to construct with a power mating port. Said two mating ports open at a side near to the second memory chip 2*b*. The two memory chips define a pair of larger through holes 21 and a pair of smaller through holes 22, which are used to assembly the BTB connectors together. The BTB connectors 1 are electrically connecting with the memory chips by contacts of the BTB connectors and conductive pads 23 of the memory chips between the pair of the larger through holes 21, which will depicted hereinafter.

Figure 4:
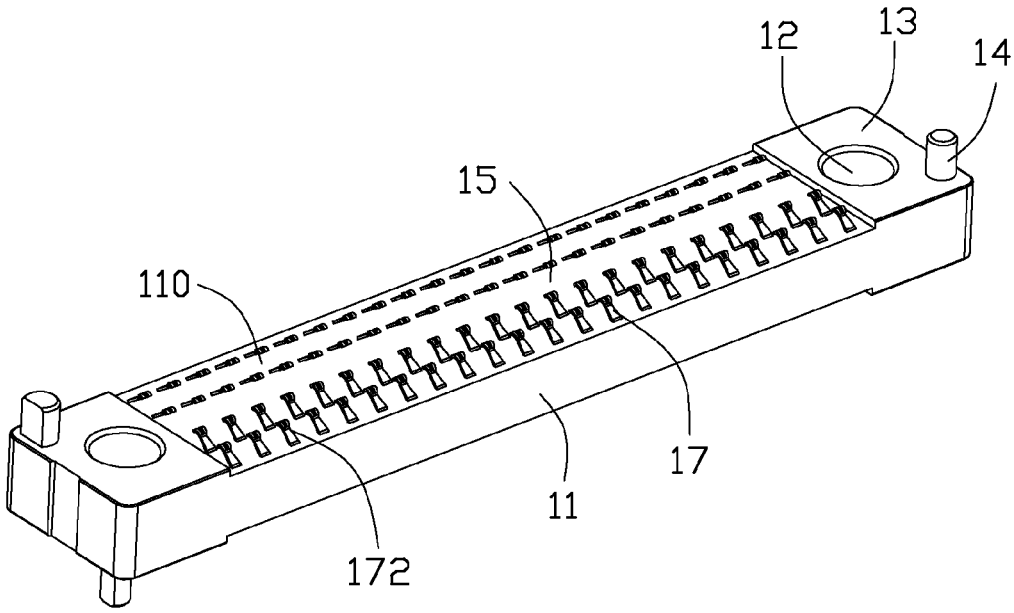
FIG. 4 is a top perspective view of an electrical connector of a first embodiment used in said SSD device.
Figure 5:
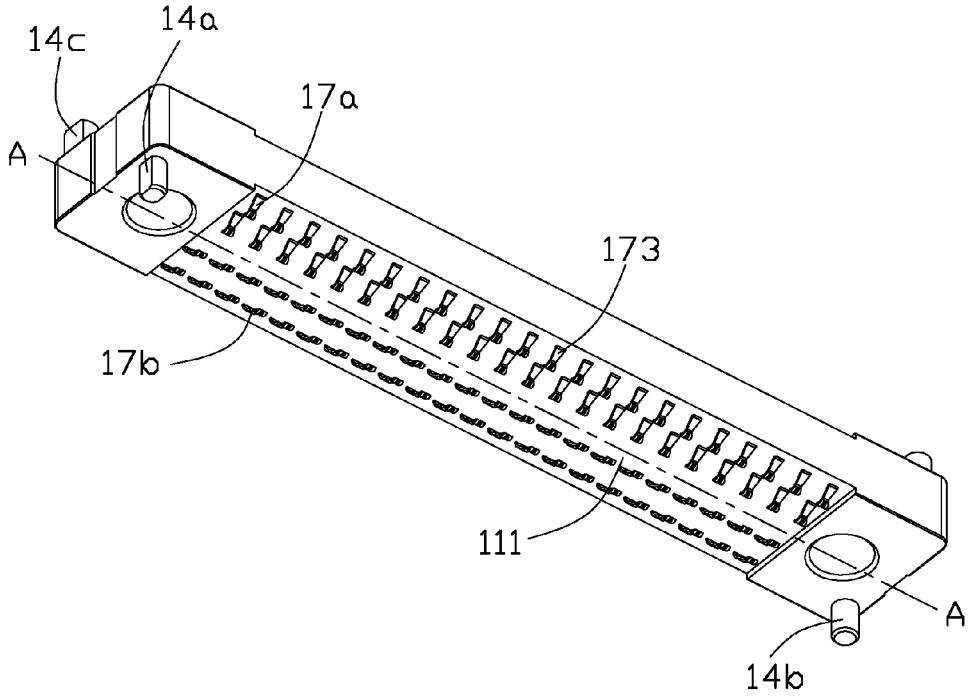
FIG. 5 is a bottom perspective view of the electrical connector.
Figure 6:
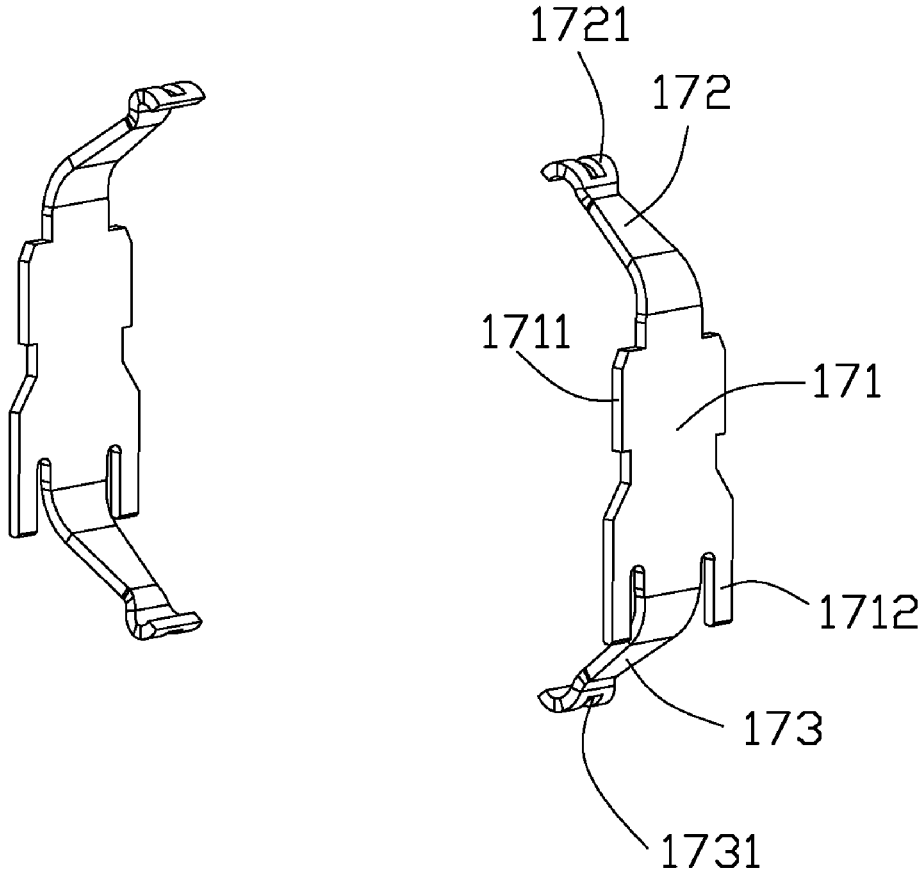
FIG. 6 is a perspective view of terminals used in the electrical connector.

Referring to FIGS. 4 and 5, the BTB connector 1 includes an insulating housing 11 defining a top surface 110 or first surface or and a bottom surface 111 or second surface. The insulating housing mainly includes two parts, a base portion 15 substantial loaded with terminals 17 and a pair of mounting portions 13 unitarily at opposite ends of the base portion 15 with a mounting hole 12 respectively. A positioning post 14 is further defined at a diagonal corner of the base portion 15 near to the mounting hole 12. The base portion 15 is arranged with four rows conductive terminals 17 which are in two groups 17*a*, 17*b* and disposed symmetrically at two sides of the base portion 15. Combination with FIG. 6, the terminals are of a same shape and each includes a retaining portion 171 with barbs 1711 at lateral sides of the retaining portion to be interfered with the base portion 15, a first contacting portion 172 and a second contacting portion 173 extending from upper and lower edges of the retaining portion 15. The first and the second contacting portions 172, 173 both extend slantwise away while at a same side of the retaining portion 171 to have elasticity. The free ends of the two contacting portions 172, 173 extending beyond top and bottom surfaces 110, 111 have arc portions 1721, 1731 and defines one slits 1731 to increase the elasticity of the contacting portions. The retaining portion 171 defines two downwardly extending parallel ribs 1712 at two sides thereof to increase the interfering force.

The insulating housing defines a central axis A (labeled in FIG. 5) substantially in a lengthwise direction. Said two mounting holes 12 are located in the central axis A and said two groups 17*a*, 17*b* of the terminals are located at two sides of the central axis. The first and second contacting portions of said two groups both slant toward the central axis A and away the first and second surfaces respectively. The contacting portions 172, 173 are disposed with an angle to the central axis A along the lengthwise direction, not perpendicular to the central axis A, thereby benefit a force balance when the memory chips are seat on the first and the second surfaces of the insulating housing.

Said two positioning posts 14*a*, 14*b* on a same surface are located on a diagonal line of the insulating housing 10 and two positioning posts 14*a*, 14*b* on opposite surfaces are located at opposite sides of the central axis A. The second surface 111 of the BTB connector confronts with and is mounted on the second memory chip 2*b* through the positioning posts 14*a*, 14*b* being inserted in the smaller through holes 22. Then the first memory chip 2*a* are assembled to the top surface 110 of the insulating housing and bolts (not shown) are inserted in the larger through holes 21 of the two memory chips and the mounting holes 12 so as to assembly said two memory chips together. The top surface of the base portion is slightly lower than that of the mounting portions 13 to allow retraction deformation of the contacting portions 172, 173 of the terminals. The positioning posts 14 define a flat surface perpendicular to the central axis to prevent said two memory chips from rotation relative to the BTB connectors.

Figure 7:
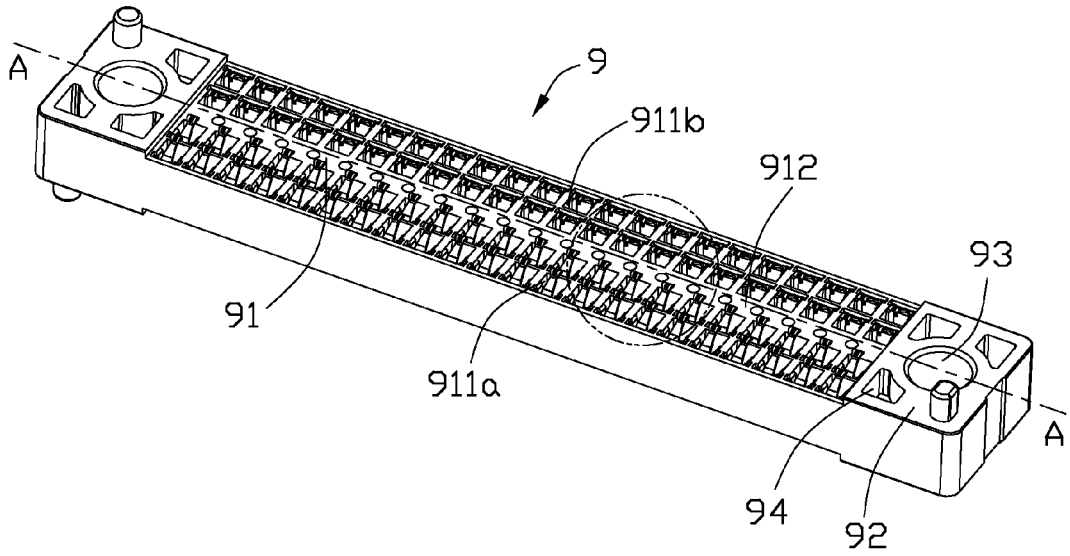
FIG. 7 is a perspective view of an electrical connector of a second embodiment.
Figure 8:
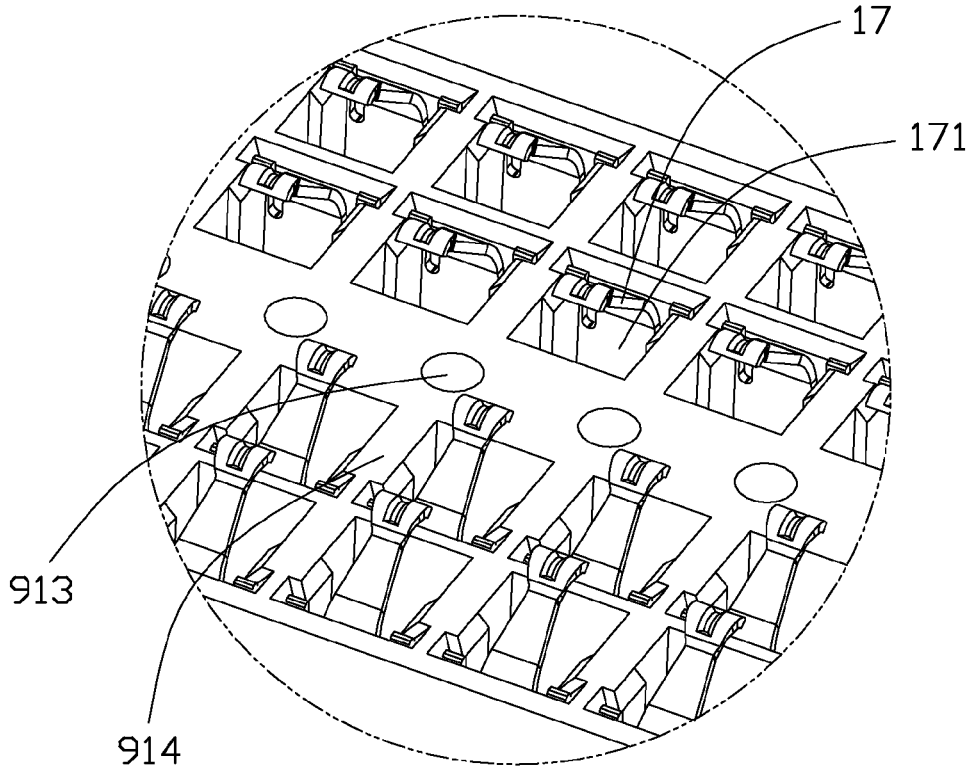
FIG. 8 is a partial enlarged perspective view of the electrical connector as shown in circle of FIG. 7.

Please referring to FIGS. 7 and 8 showing an BTB electrical connector 9 of a second embodiment, which is similar to the electrical connector 1 of the first embodiment. The base portion of insulating housing 91 defines two rows terminal passageways 911*a*, 911*b* at two sides of the central axis A. The insulating housing 91 defines a middle spine 912 along the central axis and the passageways are partitioned by partitioned walls 914 perpendicular to the middle spine 912. The middle spine 912 defines a plurality of cavity 913 which are aligned with the partitioned walls 914. The passageways 911*a*, 911*b* are larger than the contacting portions 172, 173 in dimensions so that the contacting portions can move in other directions different from the upper to bottom direction. Each mounting portion 92 further define three through holes 94 at the other corner corresponding the positioning post 14 surrounding the mounting hole 93 to increase expansion of the mounting holes 93 in a radiation direction thereof. The retaining portions of the terminals are retained in the passageways 911*a*, 911*b* in an inside away the middle spine 912. The contacting portions extend towards the middle spine 912.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector comprising:

a lengthwise insulating housing defining a central axis along a lengthwise direction thereof and comprising a base portion and two mounting portions at opposite ends of the base portion; and two groups of conductive terminals disposed in the base portion, each conductive terminal comprising a retaining portion retained in the base portion, and a first contacting portion and a second contacting portion extending oppositely from the retaining portion;

wherein said two groups of conductive terminals are located at two sides of the central axis and the first contacting portions expose to a first surface of the base portion and the second contacting portions expose to a second surface opposite to the first surface of the base portion;

wherein the first and the second contacting portions slant toward the central axis away from the first surface and the second surface respectively;

wherein the mounting portions each define a mounting hole located on the central axis and a positioning post projecting from each of the first and second surfaces;

wherein the first and second contacting portions and the second contacting portions are disposed parallel to a vertical direction perpendicular to the lengthwise direction, while the two positioning posts on the first surface are located on one diagonal corners of the insulating housing respectively and the two positioning posts on the second surface are located on another diagonal corners of the insulating housing respectively.

2. The electrical connector as described in claim 1, wherein the first and second surfaces of the base portion are lower than corresponding surfaces of the mounting surface.

3. The electrical connector as described in claim 2, wherein the mounting portion defines three though holes around the mounting hole.

4. An electrical connector assembly comprising:

opposite first and second printed circuit boards (PCBs) defining a space therebetween in a vertical direction, each of said first and second PCBs being of a rectangular configuration with four sides thereof, the first PCB being configured similar with and aligned with the second PCB in the vertical direction except a front side portion of the first PCB is removed to expose a front side portion of the second PCB on an opposite side of the space in the vertical direction;

a header connector being mounted to the front side portion of the second PCB in said space, three compression connectors mounted between other three side portions of the first PCB and the second PCB in said space; wherein each of said three compression connectors are equipped with a plurality of contacts each having opposite resilient contacting arms respectively contacting the corresponding first PCB and the second PCB.

5. The electrical connector assembly as claimed in claim 4, wherein each of said compression connectors is tightly sandwiched between said first PCB and said second PCB via a pair of bolts extending through the first PCB and the second PCB and two opposite ends of the corresponding compression connector.

6. An electrical connector assembly comprising:

opposite first and second printed circuit boards (PCBs) defining a space therebetween in a vertical direction, each of said first and second PCBs being of a rectangular configuration with four sides thereof, the first PCB being configured similar with and aligned with the second PCB in the vertical direction;

a SATA compatible connector mounted a front side of the second PCB in the space;

at least one compression connector mounted between other three side portions of the first PCB and the second PCB in said space;

wherein said at least one compression connectors is equipped with two groups of contacts at opposite sides of a central axis thereof, each contact has opposite resilient contacting arms respectively contacting the corresponding first PCB and the second PCB.

* * * * *